US009334863B2

(12) United States Patent
Stephens et al.

(10) Patent No.: US 9,334,863 B2
(45) Date of Patent: May 10, 2016

(54) PUMP

(75) Inventors: Philip John Stephens, Worthing (GB); Ian David Stones, Burgess Hill (GB); Malcolm William Gray, Crawley (GB); Paul David Neller, Worthing (GB)

(73) Assignee: Edwards Limited, Crawley, West Sussex (GB)

( * ) Notice: Subject to any disclaimer, the term of this patent is extended or adjusted under 35 U.S.C. 154(b) by 47 days.

(21) Appl. No.: 13/514,203

(22) PCT Filed: Nov. 23, 2010

(86) PCT No.: PCT/GB2010/051946

§ 371 (c)(1),
(2), (4) Date: Jun. 6, 2012

(87) PCT Pub. No.: WO2011/077105

PCT Pub. Date: Jun. 30, 2011

(65) Prior Publication Data

US 2012/0251368 A1 Oct. 4, 2012

(30) Foreign Application Priority Data

Dec. 24, 2009 (GB) ..... 0922564.0

(51) Int. Cl.
*F04C 25/02* (2006.01)
*F04C 23/00* (2006.01)
(Continued)

(52) U.S. Cl.
CPC ..... *F04C 25/02* (2013.01); *F04C 23/001* (2013.01); *F04C 27/009* (2013.01); *F04C 27/02* (2013.01); *F04C 29/0092* (2013.01); *F04C 28/02* (2013.01); *F04C 2220/12* (2013.01)

(58) Field of Classification Search
CPC .. F04C 23/001; F04C 29/0092; F04C 18/126; F04C 2220/12; F04C 25/02; F04C 27/009; F04C 28/02; F16J 15/406
USPC ..... 418/9, 15, 200, 206.6; 123/245; 277/431
See application file for complete search history.

(56) References Cited

U.S. PATENT DOCUMENTS 5,046,934 A 9/1991 Berges
5,356,275 A 10/1994 Brenner et al.
(Continued)

FOREIGN PATENT DOCUMENTS

CN 1243563 A 2/2000
CN 1871436 A 11/2006
(Continued)

OTHER PUBLICATIONS

Response dated Feb. 20, 2013 from corresponding European Application No. 10785500.9-2315.
(Continued)

*Primary Examiner* — Thomas Denion
*Assistant Examiner* — Thomas Olszewski
(74) *Attorney, Agent, or Firm* — Westman, Champlin & Koehler, P.A.

(57) ABSTRACT

A pump includes a plurality of pumping stages comprising a respective plurality of pumping mechanisms driven by one or more drive shafts for pumping fluid through the pumping stages from a pump inlet at a high vacuum stage to a pump outlet at a low vacuum stage; a lubrication chamber housing a bearing assembly for supporting the drive shaft for rotational movement, the drive shaft extending from the high vacuum stage to the lubrication chamber through an opening of a head plate of the lubrication chamber; an inter-stage purge port through which gas can enter the pump at an inter-stage location downstream of the high vacuum; a lubrication chamber purge port located in the lubrication chamber through which purge gas can flow from a source of purge gas; wherein the inter-stage port is connected to the lubrication chamber for controlling the pressure of purge gas in the lubrication chamber.

15 Claims, 4 Drawing Sheets

(51) Int. Cl.

| | |
|---|---|
| ***F04C 27/00*** | (2006.01) |
| ***F04C 27/02*** | (2006.01) |
| ***F04C 29/00*** | (2006.01) |
| *F04C 28/02* | (2006.01) |

(56) References Cited

U.S. PATENT DOCUMENTS

| | | | | |
|---|---|---|---|---|
| 6,471,497 | B2 * | 10/2002 | Suzuki et al. | 418/9 |
| 6,612,820 | B1 | 9/2003 | Staat et al. | |
| 7,134,668 | B2 * | 11/2006 | Shinozaki | 277/431 |
| 2009/0269231 | A1 | 10/2009 | Birch et al. | |

FOREIGN PATENT DOCUMENTS

| | | | |
|---|---|---|---|
| EP | 0338764 | A2 | 10/1989 |
| EP | 0365695 | A1 | 5/1990 |
| EP | 1150015 | A2 | 10/2001 |
| JP | H01315682 | A | 12/1989 |
| JP | 2001304115 | A | 10/2001 |
| JP | 2004293466 | A | 10/2004 |
| WO | 2007036689 | A1 | 4/2007 |

OTHER PUBLICATIONS

U.K. Search Report dated Jun. 4, 2010 for corresponding British Application No. GB0922564.0.

PCT International Search Report dated May 22, 12 for corresponding PCT Application No. PCT/GB2010/051946, filed Nov. 23, 2010.

PCT International Written Opinion dated May 22, 2012 for corresponding PCT Application No. PCT/GB20101051946, filed Nov. 23, 2010.

Prosecution history of corresponding Chinese Application No. 201080058543.9 including: Office Action dated May 26, 2014 and Chinese Search Report dated May 17, 2014.

Prosecution history of corresponding Japanese Application No. 2012-545437 including Notification of Reason for Rejection dated Sep. 16, 2014.

Prosecution history of corresponding Chinese Application No. 201080058543.9 including: Second Office Action dated Jan. 15, 2015.

Amendments to claims dated Aug. 3, 2015 for Chinese Application No. 201080058543.9.

Taiwanese Office Action dated Aug. 5, 2015 and Search Report dated Aug. 4, 2015 for corresponding Taiwanese Application No. 099142236.

* cited by examiner

PUMP

CROSS-REFERENCE TO RELATED APPLICATION

This Application is a Section 371 National Stage Application of International Application No. PCT/GB2010/051946, filed Nov. 23, 2010, which is incorporated by reference in its entirety and published as WO 2011/077105 A2 on Jun. 20, 2011 and which claims priority of British Application No. 0922564.0, filed Dec. 24, 2009.

BACKGROUND

The present invention relates to a positive displacement dry pump, a purge system for such a pump and a method of purging a positive displacement dry pump.

Positive displacement pumps such as roots, claw or rotary vane pumps may comprise a plurality of vacuum pumping stages having respective pumping mechanisms driven by one or more drive shafts. The drive shafts may themselves be driven by respective motors or more usually, one shaft can be driven by a motor whilst a second drive shaft is connected by a gear arrangement to the first drive shaft. Typically, the drive shafts are supported for rotation by bearing arrangements housed in lubrication chambers at the high vacuum side and low vacuum side of the pump.

The drive shafts extend through openings in head plates of the lubrication chambers and the space between the shafts and the head plates are sealed by shaft seals. Although the shaft seals are generally quite effective, leakage of fluid still occurs through the openings dependent upon the relative pressures on each side of the head plates. When pumping certain gasses, it is desirable to resist the passage of the gasses into the lubrication chambers, which degrade the lubricant and can cause damage to the pump's components. It is known to use purge gas to prevent pumped gasses from entering the lubrication chambers and this method is typically adopted at the low vacuum lubrication chamber. However, the introduction of purge gas at the high vacuum side of the pump can limit the pump's ability to generate high vacuum pressures at the pump inlet.

The discussion above is merely provided for general background information and is not intended to be used as an aid in determining the scope of the claimed subject matter. The claimed subject matter is not limited to implementations that solve any or all disadvantages noted in the background.

SUMMARY

The present invention seeks to provide an improved arrangement.

In a first aspect the present invention provides a positive displacement dry pump comprising: a plurality of vacuum pumping stages comprising a respective plurality of pumping mechanisms driven by one or more drive shafts for pumping fluid in series through the pumping stages from a pump inlet at the high vacuum stage to a pump outlet at the low vacuum stage; a lubrication chamber housing a bearing assembly for supporting the drive shaft for rotational movement, the drive shaft extending from the high vacuum stage to the lubrication chamber through an opening of a head plate of the lubrication chamber; an inter-stage purge port through which gas can enter the pump at an inter-stage location downstream of the high vacuum stage and pass only through the or each vacuum pumping stage downstream of the inter-stage port; a lubrication chamber purge port located in the lubrication chamber through which purge gas can flow from a source of purge gas; wherein the inter-stage port is connected to the lubrication chamber for controlling the pressure of purge gas in the lubrication chamber thereby resisting the passage of pumped gases from the high vacuum chamber to the lubrication chamber through the opening of the head plate during use.

It will be understood that in a second aspect the present invention provides that the purge arrangement substantially as herein described can be supplied as a kit of parts for retro fitting to the purge systems of existing pumps.

In a further aspect, the present invention also provides a method of purging a positive displacement dry pump, the pump comprising: a plurality of vacuum pumping stages comprising a respective plurality of pumping mechanisms driven by one or more drive shafts for pumping fluid in series through the pumping stages from a high vacuum stage to a low vacuum stage; and a lubrication chamber housing a bearing assembly for supporting the drive shaft for rotational movement, the drive shaft extending from the high vacuum stage to the lubrication chamber through an opening of a head plate of the lubrication chamber; wherein the method comprises: conveying purge gas from a source of purge gas to the lubrication chamber; controlling the pressure in the lubrication chamber by connecting the lubrication chamber to an inter-stage port located downstream of the high vacuum stage which in use is at a higher pressure than the high vacuum stage so that pressure in the lubrication chamber resists the passage of pumped gas from the high vacuum stage to the lubrication chamber through the opening of the head plate.

Other preferred and/or optional aspects of the invention are defined in the accompanying claims.

The Summary is provided to introduce a selection of concepts in a simplified form that are further described in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

In order that the present invention may be well understood, embodiments thereof, which are given by way of example only, will now be described with reference to the accompanying drawings, in which.

DETAILED DESCRIPTION

Figure 1:
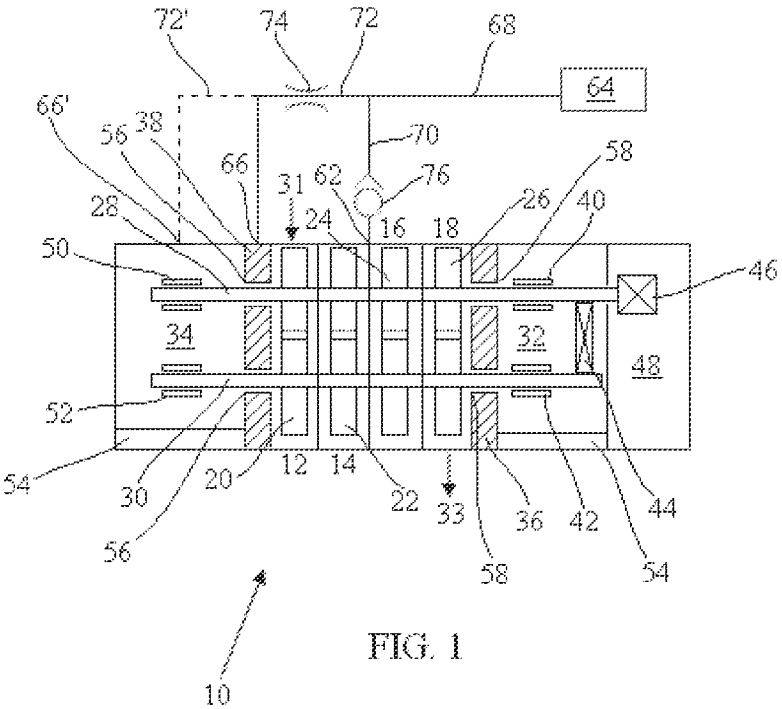
FIG. 1 shows schematically a purge system comprising a positive displacement dry pump.

Referring to FIG. 1, a purge system is shown which comprises a positive displacement dry pump 10 which is a roots type pump, but alternatively, may be for example a claw or screw type pump. The pump 10 comprises a plurality of vacuum pumping stages 12, 14, 16, 18 comprising a respective plurality of pumping mechanisms 20, 22, 24, 26. Although four pumping stages are shown, the number of stages selected depends on requirements, such as pressure required at the inlet, and pumping capacity. In a roots type pump as shown in FIG. 1, the rotors of the pumping mechanisms are driven by two drive shafts 28, 30, but in other pumps less or more shafts may be required. The pumping mechanisms are driven by the drive shafts for pumping fluid in series through the pumping stages from a pump inlet 31 at a high vacuum stage 12 to a pump outlet 33 at a low vacuum stage 16.

Lubrication chambers 32, 34 are located at opposing axial ends of the train of pumping stages and are separated from respective adjacent pumping stages 12, 18 by head plates 36, 38. Lubrication chamber 32 in this example houses a bearing assembly having bearings 40, 42 and a gear assembly 44. A motor 46 located in a motor chamber 48 drives the first shaft 28 supported by bearing 40 and the gear assembly 44 drives the second shaft 30. Lubrication chamber 34 houses a bearing assembly having bearings 50, 52 for supporting respective drive shafts 28, 30. The gear assembly 44 may be housed instead in lubrication chamber 34. Lubricant 54, such as oil, is provided in sumps of the lubrication chambers and a throwing arm (not shown) may be attached to one of the shafts for circulating lubricant in the housing for lubricating the moving parts (bearings, gears, shafts) within the chambers.

The drive shafts 28, 30 extend through openings in the head plates 36, 38 from the lubrication chambers 32, 34. An enlarged view of an opening 56 in head plate 38 between lubrication chamber 34 and high vacuum stage 12 is shown in FIG. 2.

Figure 2:
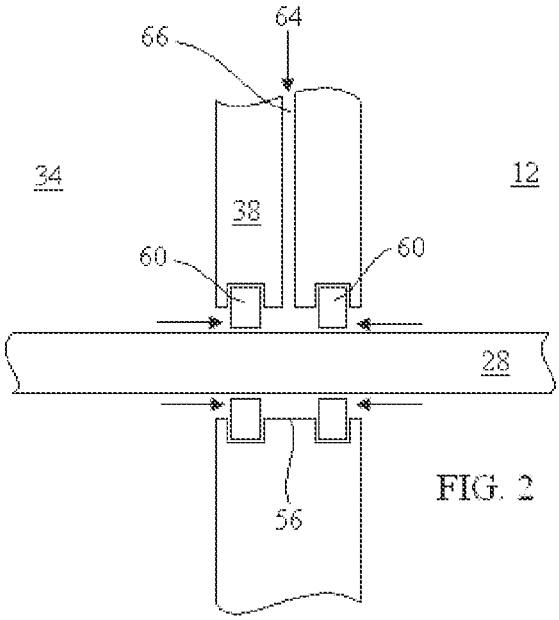
FIG. 2 shows in more detail an opening in a head plate of the positive displacement dry pump shown in FIG. 1.

In FIG. 2, the drive shaft 28 extends through the opening 56. A shaft sealing arrangement seals between the shaft and the head plate 38. In this example, the shaft seal arrangement comprises two lip seals 60 which are seated in annular recesses in the head plates and extend towards the shaft 28. Due to manufacturing tolerances and wear of the shaft seals, the shaft seals do not fully seal between the head plate 38 and shaft 28. A small amount of leakage occurs through the opening 56 represented in FIG. 2 by a gap between the lip seals 60 and the shaft. The gap is exaggerated in this example for the purposes of explanation. Accordingly, when there is a pressure gradient between lubrication chamber 34 and the high vacuum stage 12, fluid leaks through the opening 56 to either the lubrication chamber or the high vacuum stage as shown by arrows in FIG. 2. The leakage of pumped gasses and associated by-products into the lubrication chamber 34 from the high vacuum stage 12 can cause damage to the pump as explained in more detail below.

It is normal to use a non-reactive gas purge (normally nitrogen) conveyed into either the swept volume or high pressure shaft seals of a pump to minimise the effects of process gasses passing through the pump. Gas purge is normally only used at the low vacuum stages of the pump because it is at this point that process gas corrosion or condensation is most severe. The use of a gas purge at the high vacuum stages is normally not necessary and can compromise the ability of the pump to reach very low pressures.

When pumping a process chamber or tool, for example in semi-conductor, solar panel or flat panel display manufacturing chambers, some pumped process gases can be reactive and cause damage to components, such as the gear assembly (if present at the high vacuum side of the pump) or bearing assembly. For example, process by-products may condense even at low pressures. If these gasses are allowed to condense inside the low pressure gear assembly or bearing assembly, they can combine with the lubricant to form a sticky paste which coats the surfaces of the assemblies' components. Lubricant may be trapped in the paste which reduces the level of lubricant in the sump. Eventually the pump components will be starved of lubricant and the pump will be damaged.

The pressure gradient between lubrication chamber 34 and the high vacuum stage 12 is not constant. During typical operation of a pump of the type shown in FIGS. 1 and 2, the pump is initially activated and reduces the pressure at the pump inlet 31. Due to leakage from the lubrication chamber 34 to the high vacuum stage 12, the lubrication chamber is also reduced in pressure so that it is generally at the same pressure as the high vacuum stage. The pump maintains high vacuum at the inlet until it is required to pump process gasses from a processing chamber. When the pump is in this condition, it is said to be operating at 'ultimate'.

When process gasses are released from processing chamber, the pressure in the high vacuum stage is increased generating a pressure gradient from the high vacuum stage to the lubrication chamber. This pressure gradient causes process gasses to pass through opening 56 into the lubrication chamber and as indicated above, over time, cause damage to the pump's components.

The amount and composition of process gasses which are released from a processing chamber varies depending on the particular processing activity which is conducted and depending on the step in the processing activity. In this latter case, a first step may involve processing at a first pressure in the processing chamber and a second step may for example involve cleaning the process chamber at a second pressure.

After release of process gasses into the high vacuum stage, continued operation of the pump causes a pressure reduction in the high vacuum stage, which is followed by a pressure reduction in the lubrication chamber until the pressure equalizes and leakage of process gases into the lubrication chamber stops. However, processing is typically cyclical and the next step or process again causes a temporary increase in pressure in the high vacuum stage and again process gasses pass into the lubrication chamber.

The arrangement shown in FIGS. 1 and 2 controls pressure in the lubrication chamber 34 to resist the passage of pumped gases from the high vacuum stage to the lubrication chamber thereby reducing damage to the pump and improving its working life and cost of ownership.

Referring to FIG. 1, an inter-stage purge port 62 is provided through which gas can enter the pump at an inter-stage location from a source 64 of purge gas and pass only through the or each vacuum pumping stage which is downstream of the high vacuum stage. In this regard and depending on the pressure regime, the inter-stage port can be located at any position such that the pressure at the inter-stage port is higher during use that the pressure of the high vacuum stage at the openings 56. The inter-stage port may be located between any of the vacuum stages 12, 14, 16, 18 or at any of the vacuum stages 14, 16, 18 which are downstream of the high vacuum stage 12.

A purge port 66 is also provided in the lubrication chamber through which purge gas can flow from the source 64 of purge gas. The inter-stage port 62 is connected to the lubrication chamber 34 for controlling the pressure of purge gas in the lubrication chamber thereby resisting the passage of pumped gases from the high vacuum stage 12 to the lubrication chamber 34 through the opening 56 of the head plate 38 during use of the pump 10.

The location of the interstage port 62 is selected so that in use the pressure of purge gas in the lubrication chamber 34 is generally higher than the pressure of pumped gas in the high vacuum chamber 12 providing a positive pressure differential between the lubrication chamber and the high vacuum stage.

In the example shown in FIG. 1, the source 64 of purge gas has a conduit 68 which is connected to conduits 70, 72 which are in turn connected to the inter-stage port 62 and the lubrication chamber purge port 66, respectively. Accordingly, the inter-stage purge port 62 is connected to the lubrication chamber 34 by conduits 70, 72 and purge port 66. A restriction 74 is provided in the conduit 72 to reduce the conductance of purge gas flow to the lubrication chamber. The conduit 70 comprises a one-way valve 76 for resisting the passage of pumped gas from the inter-stage port to the lubrication chamber. During operation, the pressure at the inter-stage port 62 is higher than the pressure in the high vacuum chamber, and therefore, as the inter-stage port is connected to the lubrication chamber, the pressure in the lubrication chamber is higher than the pressure in the high vacuum stage generating a pressure gradient from the lubrication chamber to the high vacuum stage which resists the leakage of process gasses in the high vacuum stage to the lubrication chamber. The restriction 74 is configured to reduce the conductance of purge gas to the lubrication chamber and therefore the pressure in the lubrication chamber will be lower than the pressure at the inter-stage port, but higher than the pressure in the high vacuum stage.

For example, the pressure in the high vacuum stage may be $10^{-3}$ mbar and the pressure at the inter-stage port may be 1 mbar. The pressure in the lubrication may be in the region of $10^{-2}$ mbar thereby resisting flow of process gas into the lubrication chamber.

In operation, when the lubrication chamber and high vacuum stage are at generally the same pressure and process gasses are released into the high vacuum stage, the increase in pressure in the high vacuum stage causes an increase in pressure at the downstream inter-stage port, which in turn is communicated to the lubrication chamber so that the pressure in the lubrication chamber rises. In this way, the pressure at the inter-stage purge port is responsive to pressure of pumped gas in the high vacuum stage so that a change in pressure in the high vacuum stage causes a corresponding passive change in pressure of purge gas in the lubrication chamber. When there is an increase of flow of pumped gas into the high vacuum chamber the pressure of purge gas in the lubrication chamber is increased to resist passage of pumped gas from the high vacuum stage to the lubrication chamber through the opening in the head plate.

Referring to both FIGS. 1 and 2, the lubrication chamber purge port 66 may be located in the head plate 38 as shown so that purge gas can flow through shaft seals 60 into the opening of the head plate. This arrangement increases the differential pressure in the lubrication chamber without unnecessarily affecting other components in the lubrication chamber and conveys the purge gas to the exact position of interest. Alternatively, or additionally, as shown in broken lines in FIG. 1, a purge port 66' may be provided in the housing of the lubrication chamber 34 and connected via conduit 72' to the source 64 so that pressure in the whole lubrication chamber is raised, rather than in just the opening 56 of the head plate 38.

Whilst the invention described herein is particularly adapted for prevention of leakage of process gas through the opening of the head plate around the shaft, if it required that other leakage paths are provided in the head plate, it is also applicable to the prevention of leakage along such leakage paths.

Figure 3:
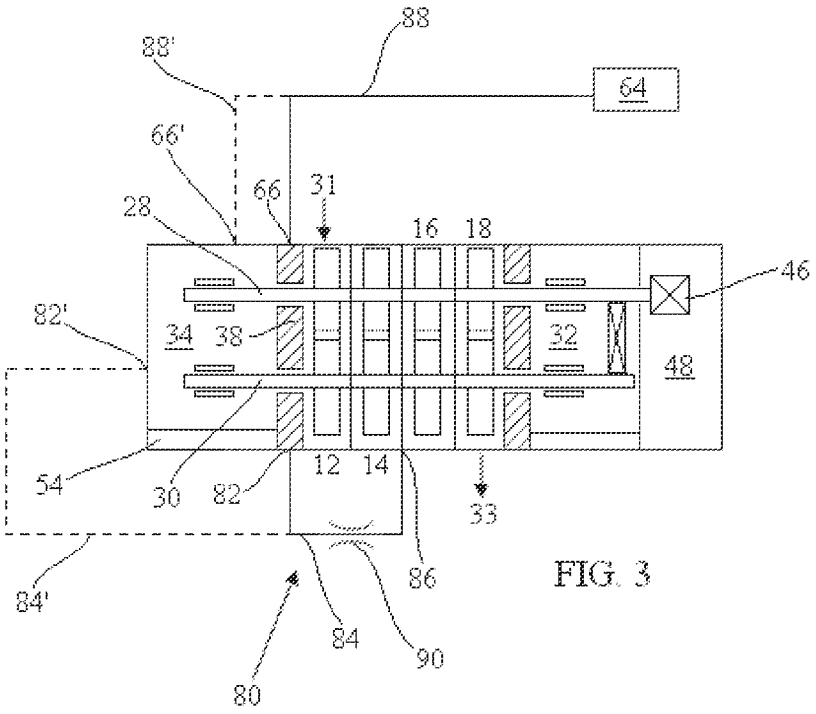
FIG. 3 shows schematically a second purge system comprising a positive displacement dry pump.

A further pump 80 is shown in FIG. 3, in which like features of the FIGS. 1 and 2 arrangement are shown by like reference numerals. The description of the FIG. 3 arrangement herein will concentrate only on the differences between this arrangement and the arrangement shown in FIGS. 1 and 2.

Figure 4:
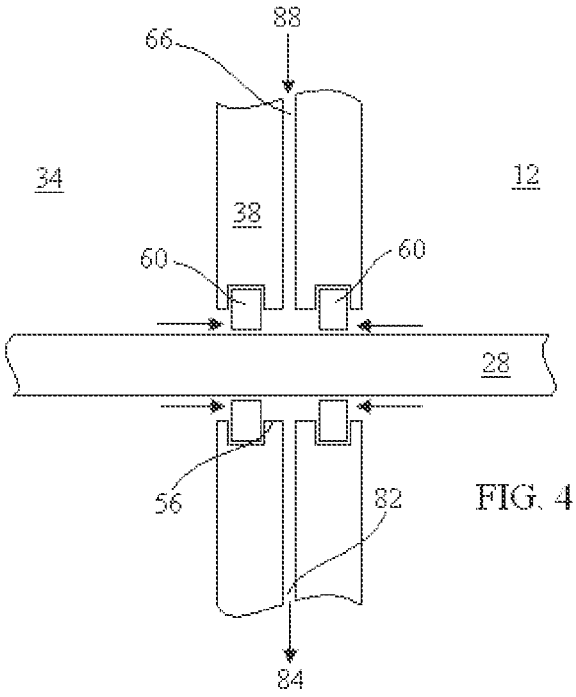
FIG. 4 shows in more detail an opening in a head plate of the positive displacement dry pump shown in FIG. 3.

In FIG. 3, the lubrication chamber 34 comprises a second purge port 82 which is connected by a conduit 84 to an inter-stage purge port 86 so that purge gas can flow from the lubrication chamber 34 to the inter-stage port. The first purge port 66 is connected by conduit 88 to the source of purge gas 64. A restriction 90 is provided in conduit 84 for restricting the conductance of the conduit. FIG. 4 shows in more detail the arrangement of the first and second purge ports 82, 84 which convey purge gas into and out of the opening 56 in the head plate 38 of the lubrication chamber 34. The FIG. 4 arrangement is similar to the FIG. 2 arrangement.

In the alternative arrangement as shown in broken lines, the lubrication chamber 34 comprises a second purge port 82' located in the body of the chamber housing which is connected by a conduit 84' to the inter-stage purge port 86 so that purge gas can flow from the lubrication chamber 34 to the inter-stage port. A second purge port 66' is connected by conduit 88' to the source of purge gas 64. The restriction 90 is provided in conduit 84'.

In operation, and when operating at ultimate, purge gas conveyed to the lubrication chamber 34 from the source of purge gas 64 is pumped by the vacuum pumping stages downstream of the inter-stage port 86, which in the example shown, includes pumping stages 16, 18. Accordingly, the pressure at the inter-stage port 86 is at a higher pressure than the pressure in the high vacuum stage 12. Although the lubrication chamber 34 is pumped at the inter-stage port 86, the restriction 90 reduces the amount of purge gas which can be pumped from the lubrication chamber, and therefore the lubrication chamber is at a higher pressure than the inter-stage port. The restriction is configured so that the pressure of purge gas in the lubrication chamber is slightly above the pressure in the high vacuum stage such that a positive pressure gradient is generated from the lubrication chamber to the high vacuum stage but the pressure gradient is not so large as to generate a high flow of purge gas through the opening 56 into the high vacuum stage. Such a flow of purge gas would, if allowed to occur, reduce the ability of the pump to achieve high vacuum pressures at the inlet 31 of the pump.

When pumped gasses are released from a process chamber through the inlet 31, the pressure in the high vacuum stage 12 rises, which after a short delay that may be in the region of a second, causes the pressure at the inter-stage port to rise. The increased pressure at the inter-stage port in turn causes an increased pressure in the lubrication chamber so that when pressure rises in the high vacuum stage the pressure is also raised in the lubrication chamber. Accordingly, the pressure in the lubrication chamber is responsive to pressure in the high vacuum stage so that a positive pressure gradient is generally maintained from the lubrication chamber to the high vacuum stage thereby resisting the passage of pumped gasses through the opening 56 into the lubrication chamber.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. A positive displacement dry pump comprising:

a plurality of vacuum pumping stages comprising a respective plurality of pumping mechanisms driven by one or more drive shafts for pumping fluid in series through the pumping stages from a pump inlet at a high vacuum stage to a pump outlet at a low vacuum stage;

a lubrication chamber housing a bearing assembly for supporting the drive shaft for rotational movement, the drive shaft extending from the high vacuum stage to the lubrication chamber through an opening of a head plate of the lubrication chamber;

an inter-stage purge port through which gas enters the pump at an inter-stage location downstream of the high vacuum stage;

a lubrication chamber purge port located in the lubrication chamber through which purge gas flows from a source of purge gas into the lubrication chamber;

wherein the inter-stage purge port is connected to a second purge port located in the lubrication chamber such that purge gas in the lubrication chamber flows out of the lubrication chamber through the second purge port and a conduit external to the pumping stages to the inter-stage purge port to thereby control a pressure of purge gas in the lubrication chamber thereby resisting a passage of pumped gases from the high vacuum chamber to the lubrication chamber through the opening of the head plate during use.

2. The pump as claimed in claim 1, wherein the location of the inter-stage purge port is selected so that in use the pressure of purge gas in the lubrication chamber is generally higher than the pressure of pumped gas in the high vacuum chamber providing a positive pressure differential between the lubrication chamber and the high vacuum stage.

3. The pump as claimed in claim 1, wherein the pressure at the inter-stage purge port is responsive to pressure of pumped gas in the high vacuum stage so that a change in pressure in the high vacuum stage causes a corresponding change in pressure of purge gas in the lubrication chamber.

4. The pump as claimed in claim 3, wherein an increase of pressure of pumped gas in the high vacuum stage causes an increase in pressure of purge gas in the lubrication chamber so that during an increase of flow of pumped gas into the high vacuum chamber the pressure of purge gas in the lubrication chamber is increased to resist passage of pumped gas from the high vacuum stage to the lubrication chamber through the opening in the head plate.

5. The pump as claimed in claim 1, wherein the lubrication chamber purge port is located in the head plate so that purge gas flows into a shaft seal in the opening of the head plate.

6. The pump as claimed in claim 1, wherein the second purge port is connected to the inter-stage purge port by a conduit and wherein the conduit comprises a restriction.

7. A method of purging a positive displacement dry pump, the pump comprising:

a plurality of vacuum pumping stages comprising a respective plurality of pumping mechanisms driven by one or more drive shafts for pumping fluid in series through the pumping stages from a high vacuum stage to a low vacuum stage; and a lubrication chamber housing a bearing assembly for supporting the drive shaft for rotational movement, the drive shaft extending from the high vacuum stage to the lubrication chamber through an opening of a head plate of the lubrication chamber;

wherein the method comprises:

conveying purge gas from a source of purge gas to the lubrication chamber;

controlling the pressure in the lubrication chamber by connecting the lubrication chamber to an inter-stage port located downstream of the high vacuum stage which in use is at a higher pressure than the high vacuum stage so that the pressure of purge gas in the lubrication chamber is higher than the pressure of pumped gas in the high vacuum chamber thereby providing a positive pressure differential between the lubrication chamber and the high vacuum stage wherein a change in pressure in the inter-stage port causes a corresponding change in pressure of the purge gas conveyed to the lubrication chamber.

8. The method as claimed in claim 7, comprising controlling the pressure of purge gas in the lubrication chamber so that it is higher than pressure of pumped gas in the high vacuum chamber irrespective of pressure changes in the high vacuum chamber.

9. The method as claimed in claim 8, wherein the pressure of pumped gas at the inter-stage port is responsive to pressure of pumped gas in the high vacuum stage and pressure of purge gas in the lubrication stage is responsive to pressure of pumped gas at the inter-stage port so that changes in pressure of the high vacuum stage cause changes in pressure in the lubrication chamber.

10. A positive displacement dry pump comprising:

a plurality of vacuum pumping stages comprising a respective plurality of pumping mechanisms driven by one or more drive shafts for pumping fluid in series through the pumping stages from a pump inlet at a high vacuum stage to a pump outlet at a low vacuum stage;

a lubrication chamber housing a bearing assembly for supporting the drive shaft for rotational movement, the drive shaft extending from the high vacuum stage to the lubrication chamber through an opening of a head plate of the lubrication chamber;

an inter-stage purge port through which purge gas enters the pump at an inter-stage location downstream of the high vacuum stage;

a lubrication chamber purge port located in the lubrication chamber and connected to a source of purge gas such that purge gas from the source of purge gas flows through the lubrication chamber purge port;

wherein the inter-stage port is connected to the lubrication chamber for controlling the pressure of purge gas in the lubrication chamber such that the pressure of purge gas in the lubrication chamber is higher than the pressure of pumped gas in the high vacuum chamber thereby providing a positive pressure differential between the lubrication chamber and the high vacuum stage wherein a change in pressure in the inter-stage purge port causes a corresponding change in pressure of the purge gas conveyed to the lubrication chamber.

11. The pump as claimed in claim 10, wherein the pressure at the inter-stage purge port is responsive to pressure of pumped gas in the high vacuum stage so that a change in pressure in the high vacuum stage causes a corresponding change in pressure of purge gas in the lubrication chamber.

12. The pump as claimed in claim 10, wherein the lubrication chamber purge port is located in the head plate so that purge gas flows into a shaft seal in the opening of the head plate.

13. The pump as claimed in claim 10, wherein the lubrication chamber purge port is connected to the inter-stage purge port by one or more conduits having a restriction so that the pressure at which purge gas flows into the lubrication chamber is controlled by the pressure at the inter-stage purge port.

14. The pump as claimed in claim 13, wherein the conduit comprises a one-way valve for resisting the passage of pumped gas from the inter-stage port to the lubrication chamber.

15. The pump as claimed in claim 10, wherein the lubrication chamber comprises a second purge port which is connected by a conduit to the inter-stage purge port so that purge gas flows from the lubrication chamber to the inter-stage purge port.

* * * * *